US011204044B2

(12) United States Patent
Zimmerman et al.

(10) Patent No.: US 11,204,044 B2
(45) Date of Patent: Dec. 21, 2021

(54) HYDRAULIC ACTUATOR CONTROL SYSTEM

(71) Applicant: CNH Industrial America LLC, New Holland, PA (US)

(72) Inventors: Joshua Zimmerman, Willow Springs, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 16/737,324

(22) Filed: Jan. 8, 2020

(65) Prior Publication Data

US 2021/0207621 A1 Jul. 8, 2021

(51) Int. Cl.
*F15B 11/04* (2006.01)
*F15B 11/042* (2006.01)

(52) U.S. Cl.
CPC ..... *F15B 11/0426* (2013.01)

(58) Field of Classification Search
CPC ..... F15B 11/0426; F15B 2211/40592
See application file for complete search history.

(56) References Cited

U.S. PATENT DOCUMENTS

| | | | | |
|---|---|---|---|---|
| 5,950,426 | A | 9/1999 | Morita et al. | |
| 6,691,435 | B1 | 2/2004 | Schultz et al. | |
| 8,103,418 | B2 | 1/2012 | Osswald et al. | |
| 9,803,748 | B2 * | 10/2017 | Hendrix | F15B 1/024 |
| 10,072,681 | B1 * | 9/2018 | Theobald | B25J 9/144 |
| 2018/0252243 | A1 * | 9/2018 | Pfaff | E02F 9/2203 |

FOREIGN PATENT DOCUMENTS

| | | | |
|---|---|---|---|
| CN | 205557639 | U | 9/2016 |
| CN | 109183892 | A | 1/2019 |
| WO | 2013123792 | A1 | 8/2013 |

* cited by examiner

*Primary Examiner* — F Daniel Lopez
(74) *Attorney, Agent, or Firm* — Peter Zacharias; Patrick Sheldrake

(57) ABSTRACT

A hydraulic actuator control system that includes an actuator. A pump pumps a hydraulic fluid to move the actuator. A first control valve fluidly couples to the pump. The first control valve provides a first hydraulic fluid flow to the actuator. A maximum first hydraulic fluid flow through the first control valve is less than a maximum required hydraulic fluid flow of the actuator. A second control valve fluidly couples to the pump. The second control valve provides a second hydraulic fluid flow to the actuator. A maximum second hydraulic fluid flow through the second control valve is less than the maximum required hydraulic fluid flow of the actuator. A controller controls the first control valve and the second control valve to provide the hydraulic fluid to the actuator.

19 Claims, 3 Drawing Sheets

HYDRAULIC ACTUATOR CONTROL SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Hydraulic systems may be used in various applications, such as within agricultural vehicles and implements. Typically, control valves are used in hydraulic systems to supply and/or drain hydraulic fluid from a work port and/or from hydraulic fluid reservoirs (e.g., tanks). On some vehicles or implements a single control valve controls flow to a hydraulic system. Depending on the size of the control valve the hydraulic system may respond rapidly or slowly. In other words, the flowrate of hydraulic fluid through the control valve determines how quickly the hydraulic system actuates. A valve that enables the rapid flow of hydraulic fluid enables rapid actuation of the hydraulic system but with low control resolution. In contrast, a valve that constricts flow may slow the actuation of the hydraulic system but provides high control resolution. Agricultural systems may therefore include two different valves to provide both rapid actuation and high control resolution. Unfortunately, these valves are used independently to actuate a hydraulic system.

BRIEF DESCRIPTION

This summary is provided to introduce a selection of concepts that are further described below in the detailed description. This summary is not intended to identify key or essential features of the claimed subject matter, nor is it intended to be used as an aid in limiting the scope of the claimed subject matter.

In one example, a hydraulic actuator control system that includes an actuator. A pump pumps a hydraulic fluid to move the actuator. A first control valve fluidly couples to the pump. The first control valve provides a first hydraulic fluid flow to the actuator. A maximum first hydraulic fluid flow through the first control valve is less than a maximum required hydraulic fluid flow of the actuator. A second control valve fluidly couples to the pump. The second control valve provides a second hydraulic fluid flow to the actuator. A maximum second hydraulic fluid flow through the second control valve is less than the maximum required hydraulic fluid flow of the actuator. A controller controls the first control valve and the second control valve to provide the hydraulic fluid to the actuator.

In another example, a work vehicle with a hydraulic actuator control system. A boom hydraulic cylinder controls movement of an attachment coupled to the work vehicle. A pump couples to the work vehicle and pumps a hydraulic fluid to actuate the boom hydraulic cylinder. A first control valve fluidly couples to the pump. The first control valve provides a first hydraulic fluid flow to the boom hydraulic cylinder. A maximum first hydraulic fluid flow through the first control valve is less than a maximum required hydraulic fluid flow of the boom hydraulic cylinder. A second control valve fluidly couples to the pump. The second control valve provides a second hydraulic fluid flow to the boom hydraulic cylinder. A maximum second hydraulic fluid flow through the second control valve is less than the maximum required hydraulic fluid flow of the boom hydraulic cylinder. A controller controls the first control valve and the second control valve to provide the hydraulic fluid to the boom hydraulic cylinder.

In another example, a hydraulic actuator system controller. The controller includes a processor that executes computer executable instructions on a computer-readable medium to change a mode of controlling a first control valve and a second control valve. The first control valve provides a first hydraulic fluid flow to an actuator. A maximum first hydraulic fluid flow through the first control valve is less than a maximum required hydraulic fluid flow of the actuator. The second control valve provides a second hydraulic fluid flow to the actuator. A maximum second hydraulic fluid flow through the second control valve is less than the maximum required hydraulic fluid flow of the actuator.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
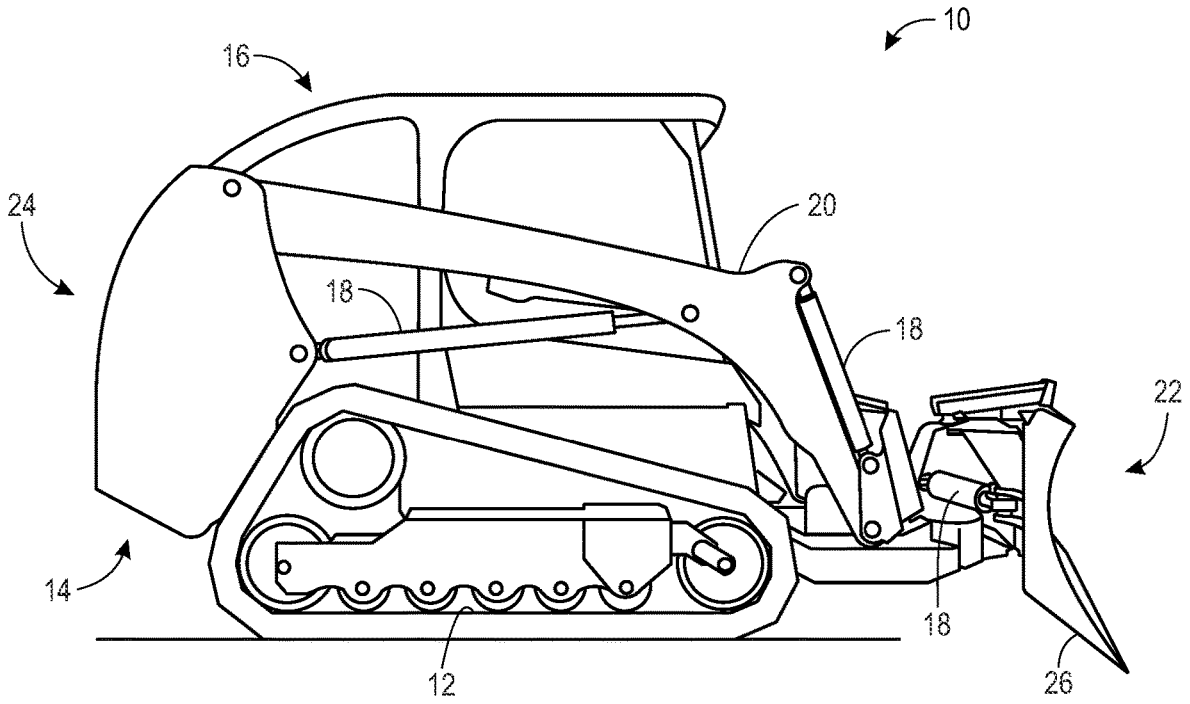
FIG. 1 is a side view of an embodiment of a work vehicle that include a hydraulic actuator control system, in accordance with the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Agricultural or work vehicles may include one or more hydraulic systems that provide power to complete various tasks. These tasks may include loading, lifting, pushing, rotating, dozing, among others. For example, some work vehicles may operate both as a loader and as a dozer. That is, the work vehicle may switch back and forth between a loading mode and a dozing mode depending on the task. However, the operator may desire different control resolutions depending on the mode of operation. For example, in a loading mode the operator may desire rapid actuation of the hydraulic system in exchange for less control over the actuation of the hydraulic system. In other words, the operator may desire a rapid response in exchange for less precise control over the movements of the hydraulic system. In a dozing operation, the operator may exchange a slower response for more precise control over the movement of the hydraulic system. The difference in control and speed of actuation is controlled using different control valves. For example, a first control valve may enable high flowrates of hydraulic fluid, which enables a rapid response from the hydraulic system but with a lower control resolution. A second control valve may have a low flowrate, which enables a slower response but with a higher control resolution. It should be understood that the terms slow response and rapid response refer to how quickly the actuator responds and not a delay between an input command and actuator motion Previously these different valves were sized in order to provide the maximum flowrate needed for the application. For example, if a first mode of operation or application needed 100 l/min and the second mode of operation or application needed 40 l/min then the first control valve would be sized to provide a maximum flowrate of 100 l/min and the second control valve would provide a maximum flowrate of 40 l/min. The disclosure below describes an actuator control system that controls two or more valves that are individually sized to provide less than the maximum flowrate needed by a hydraulic system, but when used together provide the desired maximum flowrate. For example, if the hydraulic system in a first mode needs a maximum flowrate of 100 l/min the first control valve may provide 60 l/min and the second control valve may provide the remaining 40 l/min. In order to provide this combined flow the actuator control system includes a controller configured to control the valves individually as well as simultaneously.

FIG. 1 is a side view of an embodiment of a work vehicle 10 (e.g., a skid steer). The work vehicle 10 may include tracks or wheels 12 that enable the work vehicle 10 to move. The work vehicle 10 includes an engine 14 that provides power to the tracks 12 as well as power to other systems on the work vehicle 10. These other systems may include a hydraulic system 16, light system, climate control systems among others. The hydraulic system 16 may include one or more hydraulic actuators 18 (e.g., hydraulic cylinders) that control operation of a one or more arms 20 (e.g., booms). The arms 20 couple to tools 22 that enable the work vehicle to perform various tasks. For example, the tools 22 that may be attached to the arms 20 may include forks, buckets, plows, blades, among others. Each of these tools enable the work vehicle 10 to perform one or more tasks such as loading, dozing, etc. In order to control the position of these tools 22, the work vehicle 10 may include a hydraulic actuator control system 24 that controls hydraulic fluid flow to the hydraulic system 16 (e.g., the hydraulic actuators 18). As will be explained below, the hydraulic actuator control system 24 enables the control of hydraulic control valves in order to provide the desired response and control resolution of the tools depending on the mode of operation of the work vehicle. For example, if the work vehicle 10 is being used in a loading application or mode the operator may desire a fast response and a low control resolution of a bucket 26. But if the work vehicle 10 is being used in a dozing application or mode the operator may desire an increased level of control over the position of the bucket 26 in lieu of rapid movement. The hydraulic actuator control system 24 changes the control resolution by controlling operation of valves (e.g., opening and closing).

Figure 2:
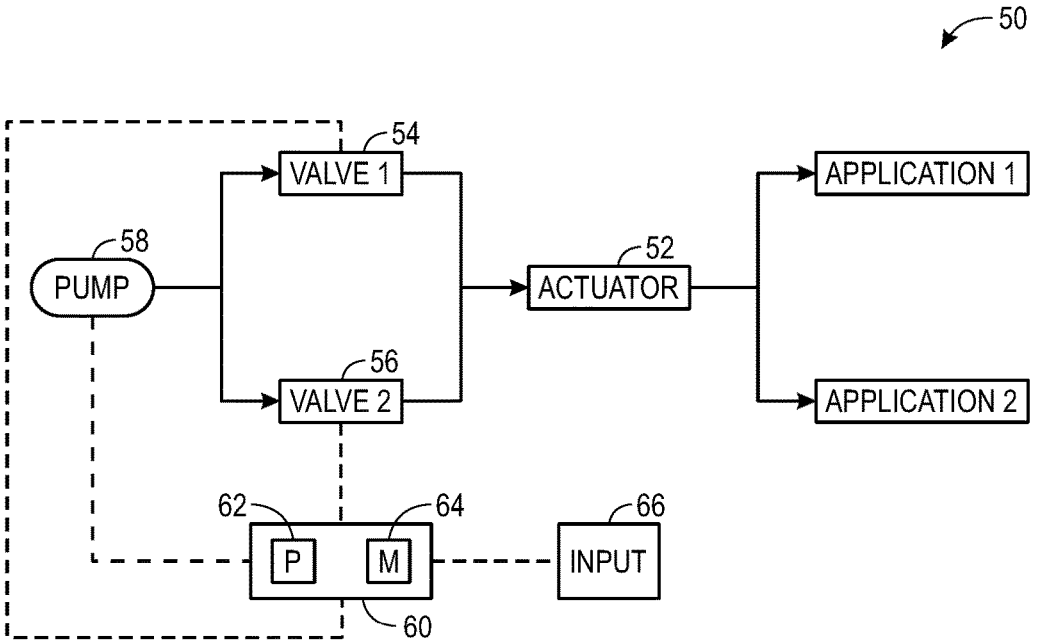
FIG. 2 is a schematic of an embodiment of a hydraulic actuator control system that may be used in the work vehicle of FIG. 1, in accordance with the present disclosure.

FIG. 2 is a schematic of an embodiment of a hydraulic actuator control system 50 that controls operation of one or more hydraulic actuators 52 by controlling operation of two or more valves. As illustrated, the hydraulic actuator control system 50 includes a first control valve 54 and a second control valve 56. Hydraulic fluid is supplied to the valves with a pump 58.

As explained above, work vehicles (e.g., work vehicle 10) may use hydraulic actuators 52 to perform various tasks such as task or application 1 and task or application 2. It should be understood that there may be different numbers of tasks or applications (e.g., 1, 2, 3, 4, 5) that may involve different hydraulic fluid flow rates and/or control resolutions. For example, some work vehicles may operate both as a loader and as a dozer. That is, the work vehicle may switch back and forth between a loading mode and a dozing mode. However, the operator may desire different control resolutions depending on the mode of operation. For example, in a loading mode (e.g., application 1) the operator may desire rapid actuation of the actuator 52 in exchange for less precise control over the movements of the actuator. In a dozing operation (e.g., application 2), the operator may exchange a slower response for more precise control over the movements of the actuator 52. The difference in control and speed of actuation is controlled using the first control valve 54 and the second control valve 56. For example, the first control valve 54 may enable high flowrates of hydraulic fluid, which enables a rapid response from the actuator 52 but with a lower control resolution. The second control valve 56 may enable a low flowrate and therefore a slower response but with a higher control resolution.

It should be understood that the first control valve 54 and the second control valve 56 are sized so that individually they are unable to provide the maximum required flowrate for one or more applications. As an example, the maximum required flowrate for application 1 may be 100l/min. However, and as an example, the maximum flowrate through the first control valve 54 may be 60 l/min. In order to provide the maximum required flowrate for application 1, the second control valve 56 may be opened. The second control valve 56, as an example, may have a maximum flowrate of 40l/min. In this way, the combined flowrate through the first and second control valves 54, 56 provides the maximum required flowrate for one or more applications on the work vehicle. The hydraulic actuator control system 50 may therefore include valves with lower flowrates but together provide the desired flowrates of hydraulic fluid. These valves may therefore reduce the overall cost of the hydraulic actuator control system 50 and the work vehicle.

To provide the desired flowrate and/or control resolution, the hydraulic actuator control system 50 includes a controller 60. The controller 60 includes a processor 62 and a memory 64. For example, the processor 62 may be a microprocessor that executes software that enables control of the first control valve 54, the second control valve 56, and the pump 58. The processor 62 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 62 may include one or more reduced instruction set computer (RISC) processors.

The memory 64 may include a volatile memory, such as random access memory (RAM), and/or a nonvolatile memory, such as read-only memory (ROM). The memory 64 may store a variety of information and may be used for various purposes. For example, the memory 64 may store processor executable instructions, such as firmware or software, for the processor 62 to execute. The memory 64 may include ROM, flash memory, a hard drive, or any other suitable optical, magnetic, or solid-state storage medium, or a combination thereof. The memory 64 may store data, instructions, and any other suitable data.

The controller 60 couples to and receives input from an input device or input system 66. For example, the input system 66 may include a joystick, touchscreen, levers, buttons, or a combination thereof that tells the controller 60 the amount of flow and/or the control resolution for a particular application. In one embodiment, an operator may push a button on the input system 66 indicative of a particular application (e.g., application 1, application 2). In response, the controller 60 controls operation of the first control valve 54 and the second control valve 56 based on the application/mode of operation. In some embodiments, the controller 60 may determine the desired application by detecting the position of the joystick and/or the change in the position of the joystick with respect to time. For example, a rapid movement of the joystick may be indicative of an application that needs a quick response. The controller 60 may therefore open the first control valve 54 or a combination of the first control valve 54 and the second control valve 56. In another situation, a slow movement of the joystick may be indicative of an application that needs precise movement control. The controller 60 may therefore open the second control valve 56 with a slow flow rate to facilitate more precise control of the actuator 52. In some embodiments, an operator may desire a training mode of operation that provides precise control of the actuator. The controller 60 receives this signal from the input system 66 and in response controls the valves 54 and 56 to provide the desired level of control.

Figure 3:
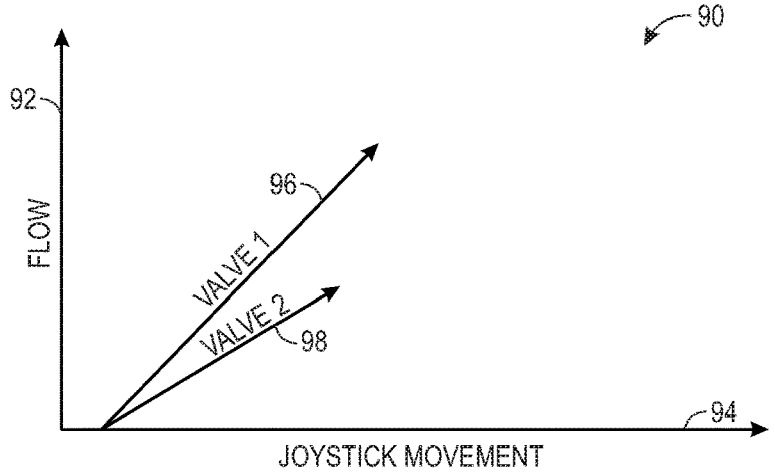
FIG. 3 is a graph of an embodiment of a hydraulic actuator control system controlling operation of a first control valve and a second control valve, in accordance with the present disclosure.

FIG. 3 is a graph 90 of an embodiment of a hydraulic actuator control system (e.g., hydraulic actuator control system 50) controlling operation of a first control valve (e.g., first control valve 54) and a second control valve (e.g., second control valve 56) for a specific mode of operation or application (e.g., loading). For example, the application may be an application that needs a rapid response from one or more hydraulic actuators with a low control resolution.

The graph 90 includes two axis, a y-axis 92 for the flowrate and an x-axis 94 for joystick movement (e.g., input). The flow rate through a first control valve is illustrated by line 96 and the flow rate through the second control valve is illustrated by line 98. After a specific amount of movement of the joystick, a controller (e.g., controller 60) simultaneously opens the first control valve and the second control valve. As the joystick continues to move the flowrate increases through both the first and second control valves. The flowrate through the first control valve is more rapid because of its higher flowrate capacity than the second valve. However, opening the first control valve and the second control valve enables a rapid response by one or more hydraulic actuators as hydraulic fluid flows through both control valves.

Figure 4:
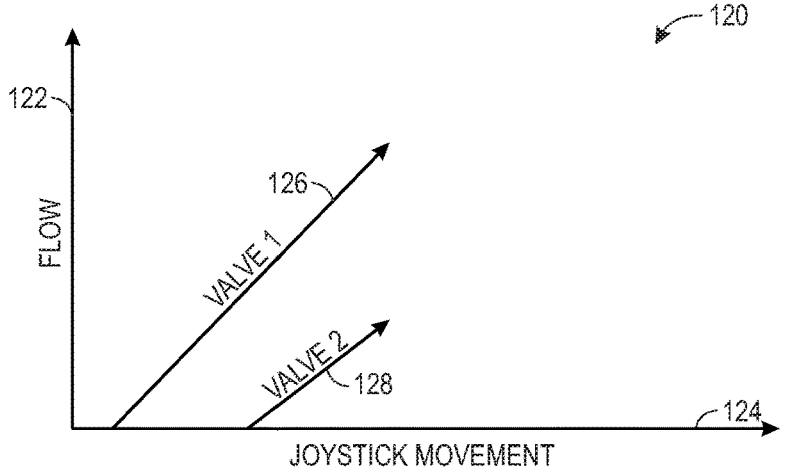
FIG. 4 is a graph of an embodiment of a hydraulic actuator control system controlling operation of a first control valve and a second control valve, in accordance with the present disclosure.

FIG. 4 is a graph 120 of an embodiment of a hydraulic actuator control system (e.g., hydraulic actuator control system 50) controlling operation of a first control valve (e.g., first control valve 54) and a second control valve (e.g., second control valve 56) for a specific mode of operation or application. For example, the application may be an application that needs a normal response from one or more hydraulic actuators. The graph 120 includes two axis a y-axis 122 for the flowrate and an x-axis 124 for joystick movement (e.g., input). The flow rate through a first control valve is illustrated by line 126 and the flow rate through the second control valve is illustrated by line 128. As illustrated, after a specific amount of movement of the joystick, a controller (e.g., controller 60) opens the first control valve. As the joystick continues to move, the flowrate increases through the first control valve. Further joystick movement is detected after which the controller opens the second valve. After opening the first and second control valves additional movement of the joystick increases the flowrate through both of the valves.

Figure 5:
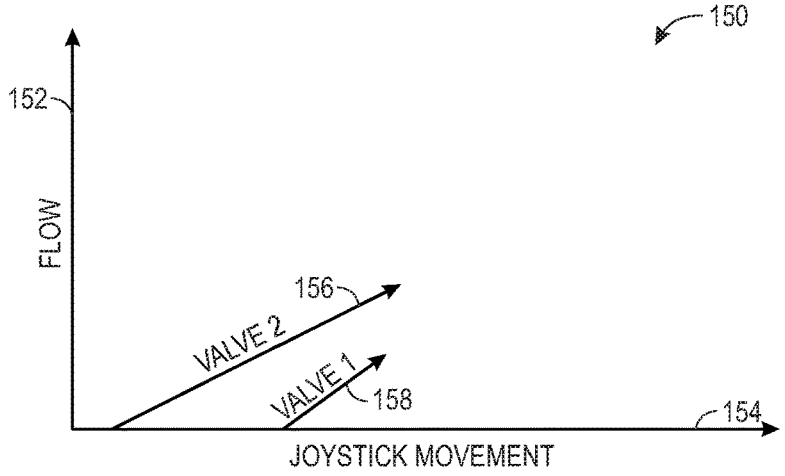
FIG. 5 is a graph of an embodiment of a hydraulic actuator control system controlling operation of a first control valve and a second control valve, in accordance with the present disclosure.

FIG. 5 is a graph 150 of an embodiment of a hydraulic actuator control system (e.g., hydraulic actuator control system 50) controlling operation of a first control valve (e.g., first control valve 54) and a second control valve (e.g., second control valve 56) for a specific mode of operation or application (e.g., dozing). For example, the application may be an application that needs a high control resolution. The graph 150 includes two axis a y-axis 152 for the flowrate and an x-axis 154 for joystick movement (e.g., input). The flow rate through a second control valve is illustrated by line 156 and the flow rate through a first control valve is illustrated by line 158. As illustrated, after a specific amount of movement of the joystick, a controller (e.g., controller 60) opens the second control valve. As the joystick continues to move the flowrate increases through the second control valve. Further joystick movement is detected after which the controller opens the first control valve. After opening the first and second control valves additional movement of the joystick increases the flowrate through the valves. In this way the initial response from the actuator is slow and controlled followed by more rapid actuation if needed.

Figure 6:
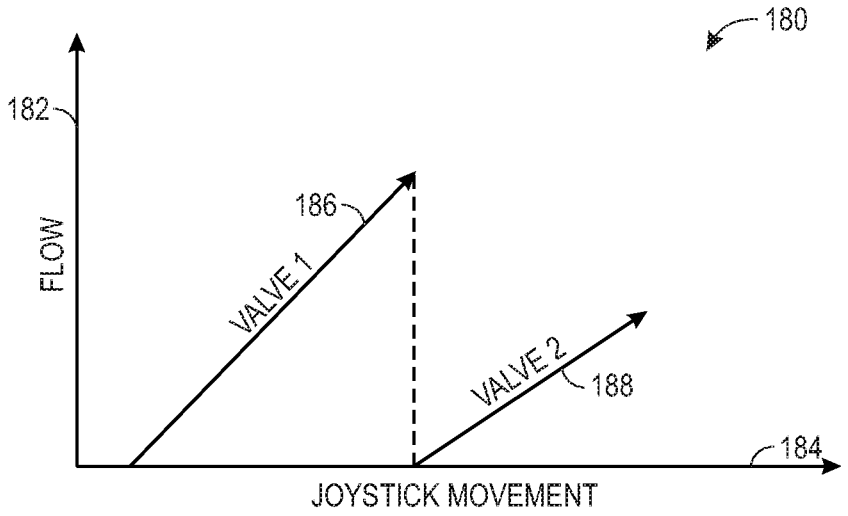
FIG. 6 is a graph of an embodiment of a hydraulic actuator control system controlling operation of a first control valve and a second control valve, in accordance with the present disclosure.

FIG. 6 is a graph 180 of an embodiment of a hydraulic actuator control system (e.g., hydraulic actuator control system 50) controlling operation of a first control valve (e.g., first control valve 54) and a second control valve (e.g., second control valve 56) for a specific mode of operation or application (e.g., loading). For example, the application may be one that needs a rapid initial response with low control resolution followed by a slower response with a higher control resolution of one or more hydraulic actuators. The graph 180 includes two axis a y-axis 182 for the flowrate and an x-axis 184 for joystick movement (e.g., input). The flow rate through a first control valve is illustrated by line 186 and the flow rate through the second control valve is illustrated by line 188. As illustrated, after a specific amount of movement of the joystick, a controller (e.g., controller 60) opens the first control valve. As the joystick continues to move the flowrate increases through the first control valve until the maximum flowrate through the first control valve is reached. Further joystick movement is detected indicating a need for increase hydraulic fluid flow. The controller then opens the second control valve releasing additional hydraulic fluid. Still further movement of the joystick increases the flowrate through the second control valve until the flowrate through the second control valve is maximized.

Figure 7:
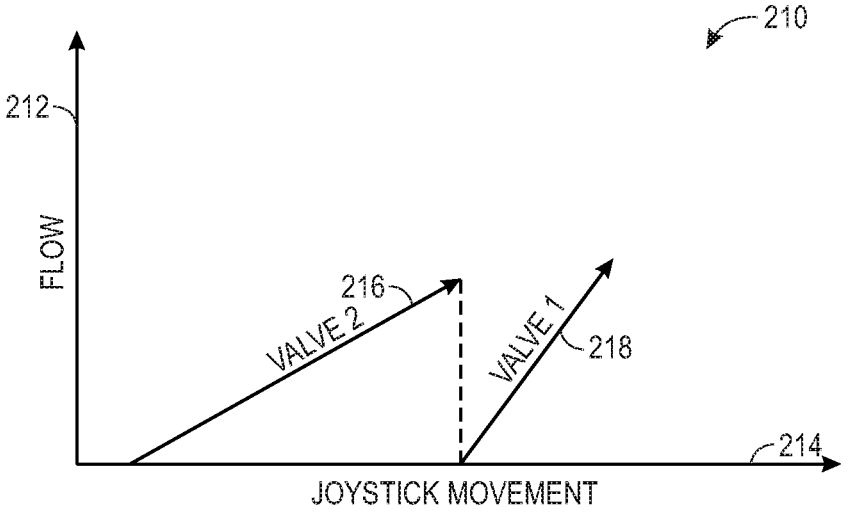
FIG. 7 is a graph of an embodiment of a hydraulic actuator control system controlling operation of a first control valve and a second control valve, in accordance with the present disclosure.

FIG. 7 is a graph 210 of an embodiment of a hydraulic actuator control system (e.g., hydraulic actuator control system 50) controlling operation of a first control valve (e.g., first control valve 54) and a second control valve (e.g., second control valve 56) for a specific mode of operation or application (e.g., dozing). For example, the application may be one that needs a slow initial response with high control resolution followed by a rapid response with a lower control resolution of one or more hydraulic actuators. The graph 210 includes two axis a y-axis 212 for the flowrate and an x-axis 214 for joystick movement (e.g., input movement). The flow rate through a second control valve is illustrated by line 216 and the flow rate through a first control valve is illustrated by line 218. As illustrated, after a specific amount of movement of the joystick, a controller (e.g., controller 60) opens the second control valve. As the joystick continues to move the flowrate increases through the second control valve until the maximum flowrate through the second control valve is reached. Further joystick movement is detected indicating a need for increase hydraulic fluid flow. The controller then opens the first control valve releasing additional hydraulic fluid. Still further movement of the joystick increases the flowrate through the first control valve until the flowrate through the first control valve is maximized.

Technical effects of the invention include an actuator control system that controls two or more valves that are individually sized to provide less than the maximum flowrate needed by a hydraulic system, but when used together they provide the desired maximum flowrate.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A hydraulic actuator control system, comprising:

an actuator configured to move;

a pump configured to pump a hydraulic fluid to move the actuator;

a first control valve fluidly coupled to the pump, wherein the first control valve is configured to provide a first hydraulic fluid flow to the actuator, and a maximum first hydraulic fluid flow through the first control valve is less than a maximum actuator hydraulic fluid flow of the actuator;

a second control valve fluidly coupled to the pump, wherein the second control valve is configured to provide a second hydraulic fluid flow to the actuator, and a maximum second hydraulic fluid flow through the second control valve is less than the maximum actuator hydraulic fluid flow of the actuator; and a controller configured to control the first control valve and the second control valve to provide the hydraulic fluid to the actuator;

wherein the controller is configured to control the first control valve and the second control valve based on a selected mode of operation of a plurality of modes of operation; and wherein the plurality of modes of operation comprises:

a first mode of operation, wherein the controller, while operating in the first mode of operation, is configured to open the first control valve to provide the first hydraulic fluid flow to the actuator and configured to open the second control valve only after the first hydraulic fluid flow through the first control valve is maximized to provide the second hydraulic fluid flow to the actuator; and a second mode of operation, wherein the controller, while operating in the second mode of operation, is configured to open the first control valve, and before maximizing the first hydraulic fluid flow through the first control valve, the controller is configured to open the second control valve to provide the actuator with the second hydraulic fluid flow.

2. The hydraulic actuator control system of claim 1, wherein the maximum first hydraulic fluid flow is greater than the maximum second hydraulic fluid flow of the second control valve.

3. The hydraulic actuator control system of claim 1, wherein the plurality of modes of operation comprises a third mode of operation, and the controller, while operating in the third mode of operation, is configured to simultaneously open the first control valve and the second control valve to provide the first hydraulic fluid flow and the second hydraulic fluid flow to the actuator.

4. The hydraulic actuator control system of claim 1, wherein the controller is configured to control the first control valve and the second control valve in response to input from a joystick.

5. The hydraulic actuator control system of claim 4, wherein the controller is configured to determine the selected mode of operation based on movement of the joystick.

6. The hydraulic actuator control system of claim 1, wherein the actuator is a boom hydraulic cylinder on a work vehicle.

7. The hydraulic actuator control system of claim 1, comprising an input system communicatively coupled to the controller, wherein the controller is configured to receive the selected mode of operation from the input system.

8. A work vehicle with a hydraulic actuator control system, comprising:

a boom hydraulic cylinder configured to control movement of an attachment coupled to the work vehicle;

a pump coupled to the work vehicle and configured to pump a hydraulic fluid to actuate the boom hydraulic cylinder;

a first control valve fluidly coupled to the pump, wherein the first control valve is configured to provide a first hydraulic fluid flow to the boom hydraulic cylinder, and a maximum first hydraulic fluid flow through the first control valve is less than a maximum cylinder hydraulic fluid flow of the boom hydraulic cylinder;

a second control valve fluidly coupled to the pump, wherein the second control valve is configured to provide a second hydraulic fluid flow to the boom hydraulic cylinder, and a maximum second hydraulic fluid flow through the second control valve is less than the maximum cylinder hydraulic fluid flow of the boom hydraulic cylinder; and a controller configured to control the first control valve and the second control valve to provide the hydraulic fluid to the boom hydraulic cylinder;

wherein the controller is configured to control the first control valve and the second control valve based on a selected mode of operation of a plurality of modes of operation; and wherein the plurality of modes of operation comprises:

a first mode of operation, wherein the controller, while operating in the first mode of operation, is configured to open the first control valve to provide the first hydraulic fluid flow to the boom hydraulic cylinder and configured to open the second control valve only after the first hydraulic fluid flow through the first control valve is maximized to provide the second hydraulic fluid flow to the boom hydraulic cylinder; and a second mode of operation, wherein the controller, while operating in the second mode of operation, is configured to open the first control valve, and before maximizing the first hydraulic fluid flow through the first control valve, the controller is configured to open the second control valve to provide the boom hydraulic cylinder with the second hydraulic fluid flow.

9. The work vehicle of claim 8, wherein the maximum first hydraulic fluid flow of the first control valve is greater than the maximum second hydraulic fluid flow of the second control valve.

10. The work vehicle of claim 8, wherein the plurality of modes of operation comprises a third mode of operation, and the controller, while operating in the third mode of operation, is configured to simultaneously open the first control valve and the second control valve to provide the first hydraulic fluid flow and the second hydraulic fluid flow to the boom hydraulic cylinder.

11. The work vehicle of claim 8, comprising an input system communicatively coupled to the controller, wherein the controller is configured to receive the selected mode of operation from the input system.

12. The work vehicle of claim 8, wherein the controller is configured to control the first control valve and the second control valve in response to input from a joystick.

13. The work vehicle of claim 12, wherein the controller is configured to determine the selected mode of operation based on movement of the joystick.

14. A hydraulic actuator system, comprising:

a controller comprising a processor and a memory, wherein the controller is configured to control a first control valve and a second control valve based on a selected mode of operation of a plurality of modes of operation;

wherein the first control valve is configured to provide a first hydraulic fluid flow to an actuator, a maximum first hydraulic fluid flow through the first control valve is less than a maximum actuator hydraulic fluid flow of the actuator, the second control valve is configured to provide a second hydraulic fluid flow to the actuator, and a maximum second hydraulic fluid flow through the second control valve is less than the maximum actuator hydraulic fluid flow of the actuator; and wherein the plurality of modes of operation comprises:

a first mode of operation, wherein the controller, while operating in the first mode of operation, is configured to open the first control valve to provide the first hydraulic fluid flow to the actuator and configured to open the second control valve only after the first hydraulic fluid flow through the first control valve is maximized to provide the second hydraulic fluid flow to the actuator; and a second mode of operation, wherein the controller, while operating in the second mode of operation, is configured to open the first control valve, and before maximizing the first hydraulic fluid flow through the first control valve, the controller is configured to open the second control valve to provide the actuator with the second hydraulic fluid flow.

15. The hydraulic actuator system of claim 14, wherein the plurality of modes of operation comprises a third mode of operation, and the controller, while operating in the third mode of operation, is configured to simultaneously open the first control valve and the second control valve to provide the first hydraulic fluid flow and the second hydraulic fluid flow to the actuator.

16. The hydraulic actuator system of claim 14, wherein the maximum first hydraulic fluid flow is greater than the maximum second hydraulic fluid flow.

17. The hydraulic actuator system of claim 14, wherein the controller is configured to control the first control valve and the second control valve in response to input from a joystick.

18. The hydraulic actuator system of claim 17, wherein the controller is configured to determine the selected mode of operation based on movement of the joystick.

19. The hydraulic actuator system of claim 14, wherein the controller is configured to receive the selected mode of operation from an input system.

* * * * *